US008932458B1

(12) United States Patent
Gianzon et al.

(10) Patent No.: US 8,932,458 B1
(45) Date of Patent: Jan. 13, 2015

(54) USING A H2S SCAVENGER DURING VENTING OF THE COKE DRUM

(71) Applicant: Marathon Petroleum Company LP, Findlay, OH (US)

(72) Inventors: Gary M. Gianzon, Metairie, LA (US); David T. Roland, Findlay, OH (US)

(73) Assignee: Marathon Petroleum Company LP, Findlay, OH (US)

( * ) Notice: Subject to any disclaimer, the term of this patent is extended or adjusted under 35 U.S.C. 154(b) by 155 days.

(21) Appl. No.: 13/773,770

(22) Filed: Feb. 22, 2013

Related U.S. Application Data

(60) Provisional application No. 61/616,026, filed on Mar. 27, 2012.

(51) Int. Cl.
*C10G 9/14* (2006.01)
*C10B 57/18* (2006.01)

(52) U.S. Cl.
CPC ..... *C10B 57/18* (2013.01)
USPC ..... 208/131; 208/132

(58) Field of Classification Search
CPC ..... C10G 9/14; C10G 9/18; C10G 9/20
USPC ..... 208/131–132
See application file for complete search history.

(56) References Cited

U.S. PATENT DOCUMENTS

| | | | |
|---|---|---|---|
| 4,176,052 | A | 11/1979 | Bruce |
| 4,302,324 | A | 11/1981 | Chen et al. |
| 4,661,241 | A | 4/1987 | Dabkowski et al. |
| 4,686,027 | A | 8/1987 | Bonilla |
| 5,045,177 | A | 9/1991 | Cooper et al. |
| 5,258,115 | A | 11/1993 | Heck et al. |
| 5,354,453 | A | 10/1994 | Bhatia |
| 5,744,024 | A | 4/1998 | Sullivan, III et al. |
| 7,078,005 | B2 | 7/2006 | Smith et al. |
| 2005/0123466 | A1 | 6/2005 | Sullivan |
| 2008/0109107 | A1 | 5/2008 | Stefani et al. |
| 2011/0155646 | A1 | 6/2011 | Karas et al. |

*Primary Examiner* — Brian McCaig
(74) *Attorney, Agent, or Firm* — Emch, Schaffer, Schaub & Porcello Co., LPA

(57) ABSTRACT

The delayed coking process comprises the steps of: thermally cracking hydrocarbon feedstock in the coke drum thereby converting the feedstock to coke and hydrocarbon products; routing thermally crack hydrocarbon products to downstream fractionators; and periodically removing coke out of the drum. Before coke removal, the drum has to be steam stripped, water quench, then vented. During venting, $H_2S$ scavenger is injected to the drum vapor space to remove residual $H_2S$.

14 Claims, 2 Drawing Sheets

USING A H2S SCAVENGER DURING VENTING OF THE COKE DRUM

CROSS REFERENCE TO RELATED APPLICATION

The present patent application is based upon and claims the benefit of provisional patent No. 61/616,026, filed Mar. 27, 2012.

FIELD OF THE INVENTION

The present invention relates to the use of a hydrogen sulfide ($H_2S$) scavenger to reduce hydrogen sulfide ($H_2S$) Emission when venting the coke drum in a delayed coker unit.

BACKGROUND OF THE INVENTION

In a delayed coking process, a heavy liquid hydrocarbon fraction is converted to solid coke, lower boiling hydrocarbon liquids, and gaseous products. The fraction is typically a residual petroleum based oil or a mixture of residual oil with other heavy fractions.

The residual oil is heated with liquid products from the process and is fed into a fractionating tower wherein light end products flashes from the residual oil. The oil is then pumped from the bottom of the fractionating tower through a furnace where it is heated to coking temperature and discharged into a coking drum.

In the coking reaction the residual feedstock is thermally decomposed into solid coke, condensable liquid, and gaseous hydrocarbons. The solid coke remains in the drum while hydrocarbon products are routed to the fractionating tower where they are separated into the desired hydrocarbon fractions.

The delayed coking drums must be vented prior to coke removal. This venting results in emission to the atmosphere. Among the emissions to the atmosphere is hydrogen sulfide which the Environmental Protection Agency has declared must be less than 10 tons per year. It is anticipated that this restriction may be reduced in the foreseeable future.

SUMMARY OF THE INVENTION

The coke drum vent gas from the delayed coker unit may contain high levels of hydrogen sulfide ($H_2S$). The invention involves the use of an $H_2S$ scavenger to reduce $H_2S$ emission when venting the coke drum to atmosphere. The scavenger reacts with $H_2S$ to form a non volatile compound.

In a preferred embodiment, the $H_2S$ scavenger is an amine hydrogen, preferably triazine. The triazine reacts with $H_2S$ to form dithiazine, a non volatile compound. However, any $H_2S$ scavenger can be used.

The delayed coking process comprises the steps of: thermally cracking hydrocarbon feedstock in the coke drum thereby converting the feedstock to coke and hydrocarbon products; routing thermally crack hydrocarbon products to downstream fractionators; and periodically removing coke from the drum. Before coke removal, the drum has to be steam stripped, water quench, then vented.

Emissions including hydrogen sulfide ($H_2S$) from the delayed coker depressurization vent were measured. The results showed high levels of $H_2S$ in the coker vent gas. Operating conditions and work practices to reduce hydrogen sulfide were adjusted. Specifically, the quenching cycle was adjusted with the direct injection of a scavenger chemical (triazine) into the coke drum. Testing shows that injecting $H_2S$ scavenger in the vapor space of the coke drum prior to venting reduces $H_2S$ emission to an acceptable level. This practice has been found to control $H_2S$ emission. The preferred embodiment uses an amine hydrogen scavenger such as triazine.

Other objects and advantages of the present invention will become apparent to those skilled in the art upon a review of the following detailed description of the preferred embodiments and the accompanying drawings.

IN THE DRAWINGS

DETAILED DESCRIPTION OF THE INVENTION

Figure 1:
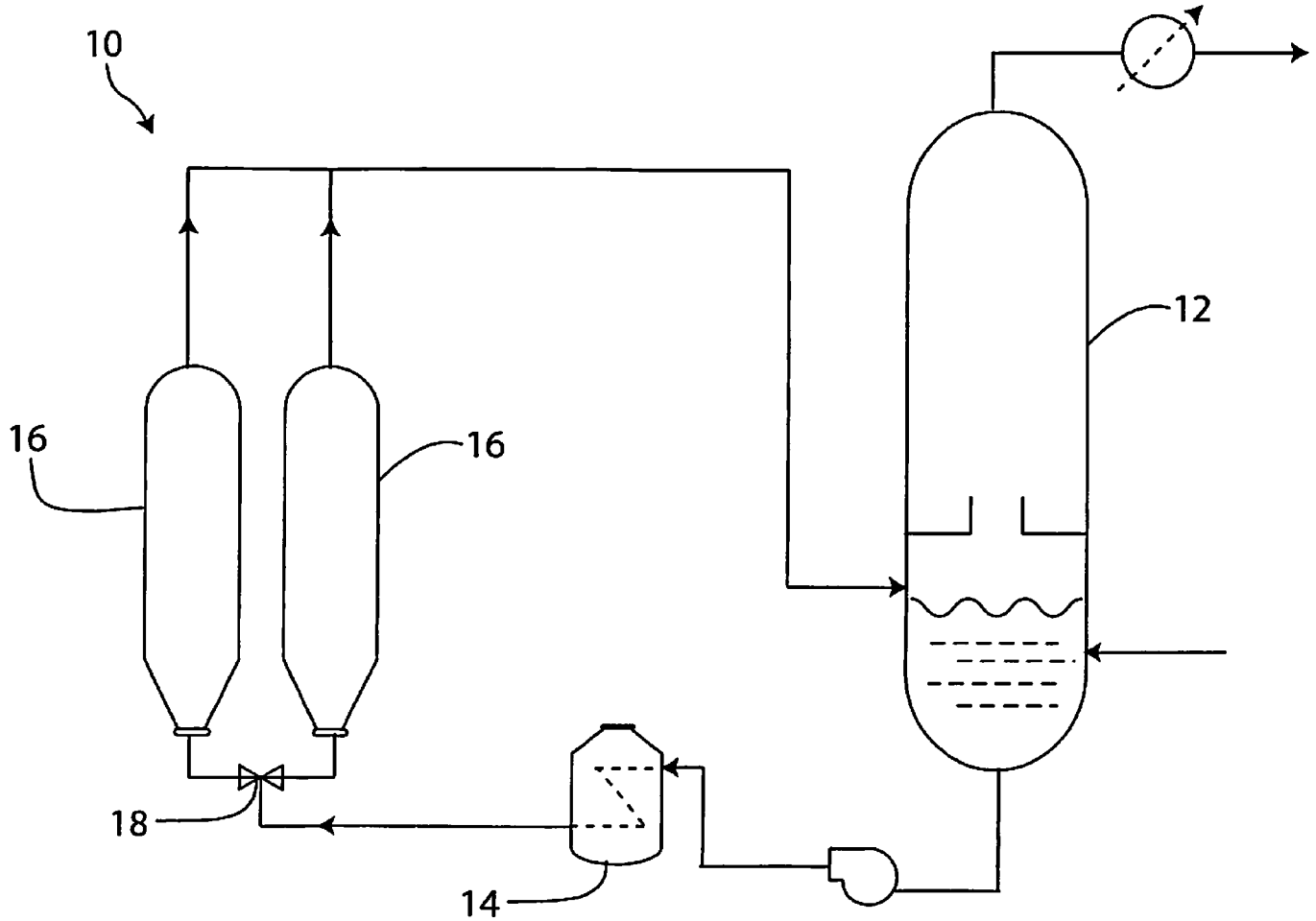
FIG. 1 shows a conventional delayed coker unit.

FIG. 1 shows delayed a coker unit 10. The heavy oil feedstock, usually a vacuum residuum, enters a fractionating tower 12. The feedstock enters the fractionating tower 12 below the level of the coker drum effluent. In many units a portion of the feed also often enters the fractionating tower 12 above the level of the coker drum effluent. The feed to the coker furnace, comprising fresh feed together with the tower bottoms fraction, is withdrawn from the bottom of the fractionating tower 12 and passes to a furnace 14 where it is brought to a suitable temperature for coking to occur in a delayed coker drums 16. Entry to the delayed coker drums 16 is controlled by switching a valve 18 so as to permit one drum to be on stream while coke is being removed from the other. The vaporous cracking products of the coking process leave the coker drums as overheads and pass into the fractionating tower 12 entering the lower section of the fractionating tower.

Figure 2:
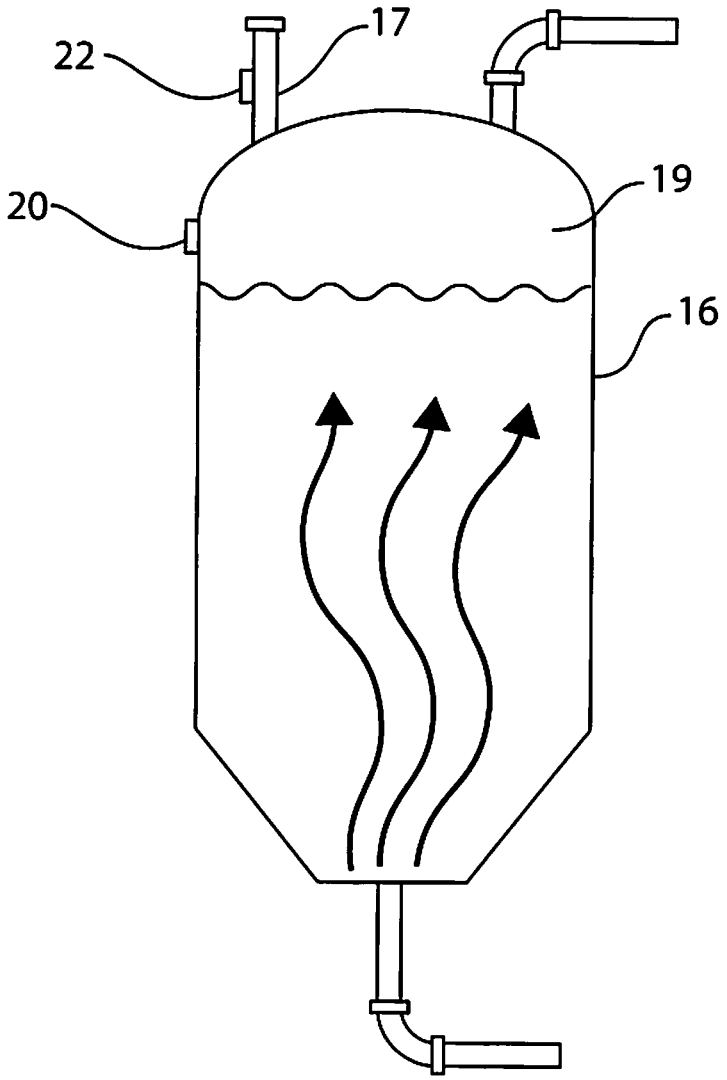
FIG. 2 shows the coke drum and scavenger points in greater detail.

FIG. 2 shows the delayed coke drums 16 and scavenger injection points 20 and 22 in greater detail.

Feed to the delayed coker drums 16 is pumped to a process heater where the heavy oil is heated to the desired thermal cracking temperature (>900 F). The vapor-liquid mixture leaving the furnace enters either of the two delayed coke drums 16 where it is converted, via thermal cracking, to lighter hydrocarbon vapors and petroleum coke. The solid petroleum coke is deposited in the coke drum. After the delayed coke drum 16 is full of solidified petroleum coke, its contents are steamed to further recover any remaining volatile hydrocarbon content from the coke, then water—quenched to lower the temperature. Once quenching is complete, the vent line 17 activates and depressures the coke drum to atmosphere.

Emissions were measured including $H_2S$ from the delayed coker drums 16 depressurization vent. The result of the testing shows high levels of $H_2S$ in the coker vent gas (average 7.1 tons/year). Modification of operating conditions and work practices to reduce hydrogen sulfide were carried out. Specifically, the quenching cycle was altered by the direct injection of an amine-based hydrogen scavenger chemical into the coke drum such as Triazine. Results show that injecting $H_2S$ scavenger in the vapor space 19 of a coke drum prior to venting significantly reduces $H_2S$ emissions to an acceptable level (average 1.5 tons/year). The $H_2S$ scavenger chemical is injected approximately 30 minutes prior to venting the delayed coke drums 16 to provide adequate time for the reaction to occur. A quill (not shown) maybe used to properly disperse the chemical in the vent stream. This practice has been added to reduce $H_2S$ emission.

The H2S scavenger is ideally injected into the vapor space 19, at injection point 20, however, it can be injected into the vent line 17, at injection point 22. Note that the hydrogen sulfide scavenger could also be injected into both the vapor space 19 and the vent line 17 at injection points 20 and 22 respectively.

Any $H_2S$ scavenger can be used to reduce $H_2S$ emissions in a delayed coking drum. Other such $H_2S$ scavengers include but are not limited to monoethanolamine (MEN, trialkyl hexahydro triazine, diethanolamine (DEA), methyldiethanolamine (MDEA), Disopropylamine (DIPA), Diglycolamine (DGA), glyoxal and a quanternary ammonium compound.

EXAMPLE

Testing was done in an attempt to reduce hydrogen sulfide emissions ($H_2S$). Different methods of reducing $H_2S$ were attempted, however, it became clear that the most significant and consistent reduction in $H_2S$ occurred when 30 gallons of a $H_2S$ scavenger was injected at the top of the coke drum approximately 30 minutes prior to venting through the coker steam vents. H2S was reduced from 18.5 tons per year (TPY) to 5.7, 1.1 and 0.1 TPY respectively. When the H2S scavenger is added 30 minutes prior to venting.

Run 1 represents results when no $H_2S$ scavenger is added.

Runs 2-4 indicate results when 30 gallons of a $H_2S$ scavenger is added to the coke drum approximately 30 minutes prior to venting.

Run 5 represents the results when 15 gallons of hydrogen sulfide scavenger is added to the coker steam vent while venting.

| Operating Parameter | Units | Run 1 | Run 2 | Run 3 | Run 4 | Run 5 |
|---|---|---|---|---|---|---|
| Coker Operating Data | | | | | | |
| Coke Drum Pressure | psig | 2 | 1.3 | 1.8 | 2 | 2.14 |
| Drum Overhead Temp | F. | 288 | 278 | 350 | 257 | 271 |
| Volume of Quench Water | Gallons | 253,000 | 270,000 | 278,000 | 281,000 | 236,000 |
| Quench Cycle Duration | Hours | 6.5 | 6.5 | 6.9 | 6.7 | 6.5 |
| Quench Water per Tons of Coke | Gallons/ tons | 142 | 152 | 151 | 167 | 134 |
| Pressure drop from Drum overhead to VGC | psi | 0.8 | 0.5 | 1.0 | 1.2 | 1.3 |
| Coke Drum Steamout (frac + blowdown) | Minutes | 66 | 57 | 60 | 63 | 60 |
| Sour Water Make/ Ton of Coke | gallons/ tons | 35 | 28.15 | 30 | 29.3 | 29.5 |
| Coker Vent Emission Data | | | | | | |
| Total Vent Gas Volume | set | 341,358 | 528,078 | 190,273 | 337,524 | 470,999 |
| Duration of Venting | Minutes | 43 | 62 | 36 | 41 | 45 |
| Non Methane/Non Ethane Volatile Organic Compounds | | | | | | |
| Concentration | ppmv-wet | 4,078 | 3,214 | 2,270 | 2,221 | 483 |
| Emissions/Cycle | lbs/cyde | 183 | 222 | 50 | 74 | 25 |
| Annual Emissions | tpy | 47.2 | 57.3 | 12.9 | 19.1 | 6.5 |
| Hydrogen Sulfide Concentration | ppmv-wet | 2,076 | 594(1) | 241(1) | 1(1) | 1370(2) |
| Emissions/Cycle | lbs/cycle | 71.8 | 22.2 | 4.3 | 1.0 | 60.7 |
| Annual Emissions | TPY | 18.5 | 5.7 | 1.1 | 0.1 | 15.6 |

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A delayed coking process comprising the steps of:

thermally cracking hydrocarbon feedstock in a coke drum thereby converting the feedstock to coke and hydrocarbon products;

routing thermally cracked hydrocarbon products to downstream fractionators;

periodically removing coke out of the drum;

steam stripping the drum prior to removing the coke;

water quenching the drum prior to removing the coke;

venting the drum prior to removing the coke; and injecting hydrogen sulfide scavenger into a vapor space of the drum prior to venting to reduce hydrogen sulfide concentration.

2. A process according to claim 1 wherein the hydrogen sulfide scavenger is injected through a vent line extending from the vapor space.

3. A process according to claim 1 wherein the hydrogen sulfide scavenger is added 5 to 60 minutes prior to venting.

4. A process according to claim 1 wherein the hydrogen sulfide scavenger is added to 15 to 45 minutes prior to venting.

5. A process according to claim 1 wherein the hydrogen sulfide scavenger is added 30 minutes prior to venting.

6. A process according to claim 1 wherein the hydrogen sulfide scavenger is an amine hydrogen sulfide scavenger.

7. A process according to claim 1 wherein the hydrogen sulfide scavenger is a triazine.

8. A process according to claim 1 wherein the hydrogen sulfide scavenger is a glyoxal and a quanternary ammonium compound.

9. A process according to claim 1 wherein the hydrogen sulfide scavenger is a monoethanolamine (MEA).

10. A process according to claim 1 wherein the hydrogen sulfide scavenger is a trialkyl hexahydro triazine.

11. A process according to claim 1 wherein the hydrogen sulfide scavenger is a diethanolamine (DEA).

12. A process according to claim 1 wherein the hydrogen sulfide scavenger is a methyldiethanolamine (MDEA).

13. A process according to claim 1 wherein the hydrogen sulfide scavenger is a Diisopropylamine (DIPA).

14. A process according to claim 1 wherein the hydrogen sulfide scavenger is a Diglycolamine (DGA).

* * * * *